United States Patent [19]

Welter

[11] 4,053,365

[45] Oct. 11, 1977

[54] ROTARY CALCINER

[75] Inventor: Franklin H. Welter, Port Arthur, Tex.

[73] Assignee: Great Lakes Carbon Corporation, New York, N.Y.

[21] Appl. No.: 637,068

[22] Filed: Dec. 2, 1975

[51] Int. Cl.[2] ..... C10B 49/06

[52] U.S. Cl. ..... 202/100; 202/117; 202/129; 202/131; 202/136; 202/216; 201/27; 201/36; 201/33; 201/25; 432/110; 432/113; 432/117; 34/141; 34/135; 23/279

[58] Field of Search ..... 201/27, 36; 202/117, 202/100, 129, 131, 136, 216; 432/110, 113, 117; 34/140, 141, 133, 134, 135, 136, 137, 138; 23/279

[56] References Cited

U.S. PATENT DOCUMENTS

| | | | |
|---|---|---|---|
| 1,503,193 | 7/1924 | Lindhard | 34/137 X |
| 1,564,730 | 12/1925 | Walden | 201/27 X |
| 2,132,709 | 10/1938 | Vanderwerp | 34/135 |
| 2,813,822 | 11/1957 | Collier | 201/27 X |

*Primary Examiner*—James H. Tayman, Jr.
*Attorney, Agent, or Firm*—Carl F. Peters

[57] ABSTRACT

A modified rotary kiln suitable for calcining normally solid carbonaceous material, having adapted thereto at one end a firing crown and means for admitting combustible gases or liquids and air; a feeding means for such solid carbonaceous material to be calcined adapted to the other end of the kiln; and wherein the combustion gases and solid materials travel countercurrently in the kiln during calcination, wherein: at least one series of at least two tuyeres passes through the wall of the kiln symmetrically spaced to and at about a point longitudinally in the middle one-half of the longitudinal axis of the kiln; each tuyere terminating within the kiln through a nozzle on the side of the tuyere at a height sufficient for the discharge of exterior oxidizing gases passing therethrough at a point above the bed of the carbonaceous material in the kiln, directing the exterior oxidizing gases toward the feed end at about the same acute angular direction from a line passing through the nozzle and parallel to the longitudinal axis of the kiln; at least one shroud which surrounds the kiln and is movably mounted with respect to the kiln wall, thereby allowing the kiln to rotate therewithin, each tuyere terminating on the outside of the kiln within the shroud; means at the junction of each tuyere with the interior surface of the kiln lining to cause forced movement of the carbonaceous material past the tuyeres; and means to cause air or other oxygen-containing gases to flow into the shroud, through the tuyeres, and into the kiln.

2 Claims, 9 Drawing Figures

ROTARY CALCINER

BACKGROUND OF THE INVENTION

This invention pertains to an improvement in the method and apparatus for the controlled partial decomposition of a solid carbonaceous material into combustible gases and an oxidizable solid residue.

More particularly, my invention relates to the calcining of petroleum coke.

Traditionally, such calcining has been done in a rotary kiln. The rotary kiln is a long, rotating tube, generally called a shell, lined with a refractory and mounted at a slight angle from the horizontal. Uncalcined coke, called green coke or raw coke, is fed into the kiln at the upper end, and heat is supplied at the lower end or firing crown by the burning of a heating fuel of combustible liquids or gases; for example, fuel oil, bunker oil, natural gas, synthesis gas, producer's gas, or the like. Coke passes through the kiln toward the firing crown by tumbling through the rotating shell. Substances that are volatile at the high temperatures generated in the kiln are evaporated and are partially burned by secondary air fed into the kiln around the firing crown. In the usual kiln design, all of the excess air necessary to provide the oxidative atmosphere to consume some or all of the evaporated combustible material from the coke is provided at the firing crown and passes the length of the kiln.

In the description, air is conveniently called primary air when it is mixed and fed with the heating fuel, and secondary air when it enters the kiln at and around the rotary seal at the firing crown end of the kiln.

Several modifications of this design have been disclosed in the prior art. Among the prior art methods controlling air flow in the kiln are those of Walden, U.S. Pat. No. 1,564,730; Nielsen, U.S. Pat. No. 1,908,651; Borch, U.S. Pat. No. 2,710,280; and Collier, U.S. Pat. No. 2,813,822.

In the Walden modification, the kiln is equipped with tuyeres arranged symmetrically about the shell and disposed along a considerable portion of the length of the shell. The tuyeres are equipped with regulating devices to allow for control of the air being admitted to the kiln, and nozzles or air outlets on the inside of the kiln. The nozzles direct the air within the kiln either radially or axial to the longitudinal axis of the kiln with nozzle openings facing both the feed end and firing crown.

Nielsen provides that both the combustible gas inlet, at the firing crown, and the volatile product exhaust, at the feed end, be modified to consist of pipes fitted with or expanded to include conical extensions within the kiln for the purpose of providing and controlling a swirling movement to the heated gases in the kiln.

Borch provides an electrically heated kiln wherein, during the passing of coke through a preheating zone, both the sensible and latent heat of the expelled volatiles are utilized by burning the volatiles by means of air supplied by pipes (tuyeres) through the walls of the kiln. The air from these pipes is directed toward the discharge end of the kiln in a stream parallel with the longitudinal axis thereof. The area of burning is isolated, so as to not include the heating zone, by control of the air intake and volatile product exhaust.

In all of the preceding modifications, the oxidizing gases are admitted to the kiln at or near the central longitudinal axis of the kiln, or at least above the coke bed. Collier discloses a traditional countercurrent rotary gas fired kiln wherein additional air is admitted in the preheating zone but at the surface of the refractory lining of the kiln below the coke bed with the nozzles disposed in the refractory material. Collier does not provide for a volatile product exhaust in the preheating zone as does Borch, and the combustible products are discharged along with the rest of the gaseous exhaust products at the coke feed end.

SUMMARY OF THE INVENTION

The throughput characteristics of a particular kiln are generally controlled by the shell diameter, angular velocity, and pitch from horizontal of the kiln and the coke bed thickness. These factors are usually adjusted to provide a maximum product of acceptable properties in the highest yield.

In order to increase the throughput of the kiln and to lower the heating fuel requirements, I have invented a certain novel modification of the calcination process which is carried out by certain novel modifications to the basic kiln structure.

The novel calcination process and kiln design of this invention are especially useful in improving the economics of the process of coke calcination. For example, a 40–50% increase in coke throughput providing calcined coke in an equal to or better yield per ton of coke-feed and utilizing 50–60% of the combustion fuel requirements per ton of coke throughput can be realized with little or no loss in quality.

The method of this invention provides a two-stage heating process to distill and remove volatile material from the coke as it passes through the kiln. As the coke enters and starts tumbling through the kiln, it is gradually heated by the burning of the fuel gas and the combustible volatile material which has previously been released by the coke already treated to a higher temperature at a point further down the kiln. This heating distills volatile material from the raw coke, allowing such distillation product to become available for combustion. The oxidative atmosphere for combustion of these volatile materials in my modification is provided for by a series of symmetrically placed tuyeres passing through the shell of the kiln at a point longitudinally in the middle one-half of the kiln, terminating within the kiln at a point above the coke bed. Air or other oxidative atmosphere directed into the tuyeres from the outside of the kiln exits therefrom inside the kiln in a direction toward the cokefeed end and at an acute angle from the axis of the kiln to provide a vortex flow effect of oxidative gases within the upper portion of the kiln. Combustive oxidation, then, occurs at a point from about the middle of the kiln to the point where an oxidative atmosphere is depleted near the coke-feed end of the kiln.

In a preferred embodiment, in order to prevent a buildup of coke at the base of the tuyeres causing coke loss from excessive oxidation at these points of high oxidation potential, the coke is forced past the tuyeres by the rotating action of an inclined plane built into the refractory at the base of the tuyeres.

After passing the tuyeres, the coke is then subjected to a typical high-temperature heat soak in a substantially nonoxidative atmosphere by contact with the flame from the burning combustion fuel gas located at the firing crown. Preferably, secondary air at the firing crown is minimized by means of a rotary seal.

The kiln providing such a novel calcination method is a modified countercurrent rotary kiln slightly inclined from the horizontal and equipped with a coke feed at the upper end and a firing crown at the lower end. The kiln is equipped with a series of tuyeres symmetrically spaced around the kiln in about the middle one-half of the length of the kiln, each tuyere terminating inside the kiln above the coke bed in an opening perpendicular to the radius of the kiln and at an acute angle from the axis of the kiln. All openings are pointed in the same direction to provide a vortex air flow toward the coke-feed end of the kiln. At the base of each tuyere inside the kiln, the brick or other refractory surface of the kiln is preferably built up in a triangular pattern to provide an inclined or similar plane which forces the coke past the tuyere during rotation. Outside the kiln, the tuyeres terminate in one or more shrouds which surround the kiln and which are movably mounted with respect to the kiln surface to allow the kiln to rotate within the shrouds. Air or other oxygen containing or oxidative gases is provided to the shrouds by one or more stationary fans and the appropriate duct work leading to the shrouds.

DETAILED DESCRIPTION OF THE DRAWINGS

In order to more clearly disclose the construction, operation, and use of the invention, reference should be made to the accompanying drawings forming part of the invention. Throughout the several views in the drawings, like reference characters designate the same parts.

The drawings illustrate the installation of one shroud and one or two sets of tuyeres terminating in the shroud. The installation and modification of these embodiments to provide additional sets of tuyeres and/or an additional shroud would be obvious, well within the skill of one in the art, and within the scope of my invention given the following description.

Figure 1:
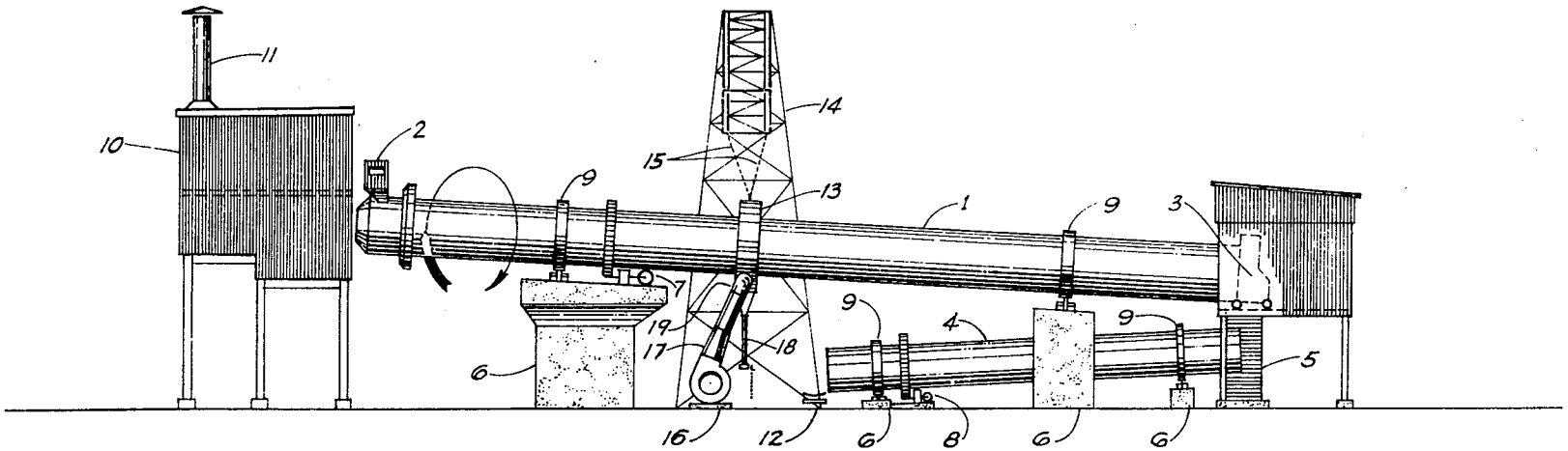
FIG. 1 is a drawing of a rotary kiln and cooler for the calcination of carbonaceous materials; as for example, coal and petroleum coke, as modified to include an embodiment of my invention.

In the conventional process for calcination of coal or petroleum coke in a rotary kiln, a thin shell 1 is fitted with a coke feeding device 2; as for example, a series of scoops and an external trough, or a funnel for the feeding of the solid coke or coal to the kiln. At the other end of the kiln is a firing crown 3 where gas, oil, or a similar fuel is burned, the heat and flame of combustion traveling through the kiln to heat the solid material. The coke feed end of the shell is raised slightly from the horizontal on piers 6 and the shell is rotated by a kiln drive motor and gears 7 on tires 9 causing the coke to slowly tumble through the length of the shell eventually falling from the shell at the firing crown end through a discharge chute 5 into a cooler 4. In the cooler, a similar variation of height from the horizontal and a rotary motion provided by a cooler drive motor 8 which rotates the cooler on tires 9 causes the calcined coke to tumble the length of the cooler, eventually falling into the conveyor 12 for further disposition and use.

Gaseous discharge products containing entrained solids from the calcination process are lead through a settling chamber 10, through stack 11, into the atmosphere.

My invention has modified this basic kiln design by providing a second heating zone of different gas flow characteristics beginning at about the midpoint of the kiln. In order to provide this heating zone, a shroud 13 comprising a transverse wall 33 and a surface plate 36 has been movably mounted over the kiln at about the midpoint. A convenient method of supporting the shroud against the angular forces of the revolving kiln shell has been conveniently provided by hanging the shroud from an overhead tower 14 by cables 15. Wheels 23, freely movable on slidably mounted axles 24, are mounted on the transverse wall 33 of the shroud. These wheels are freely rotatable in channel 25 to provide lateral stability to the shroud, which, because of the slope of the kiln, would otherwise tend to ride down the shell as the shell revolved. Tuyeres 27 are mounted on the kiln terminating outside the kiln in the shroud, through the shell 1 and refractory kiln lining 26, and terminating above the coke bed inside the kiln.

A fan 16 is mounted on the ground or other stationary position, convenient to source of power to provide the external oxidizing gas. Ducts 17 connected by a flexible joint 19 led from the fan to the shroud. The velocity of exterior oxidizing gas, tertiary air or the like, which passes through the tuyeres, and the position and direction of the nozzles 32 in the kiln appear to prevent loss of solid coke particles through the tuyeres and into the shroud. However, in order to protect the system against such coke buildup, the duct 17 is preferably mounted on the shroud on the same side as the kiln shell is traveling downwards in its motion. Further, I have provided a clean-out 18 attached to the shroud through adapter plates 34 and a funnel 35. The clean-out is equipped with a normally closed clean-out valve 21, with a pull chain 22, which can be operated at regular intervals to open the clean-out and remove coke particles that may have fallen into the shroud.

Figure 2:
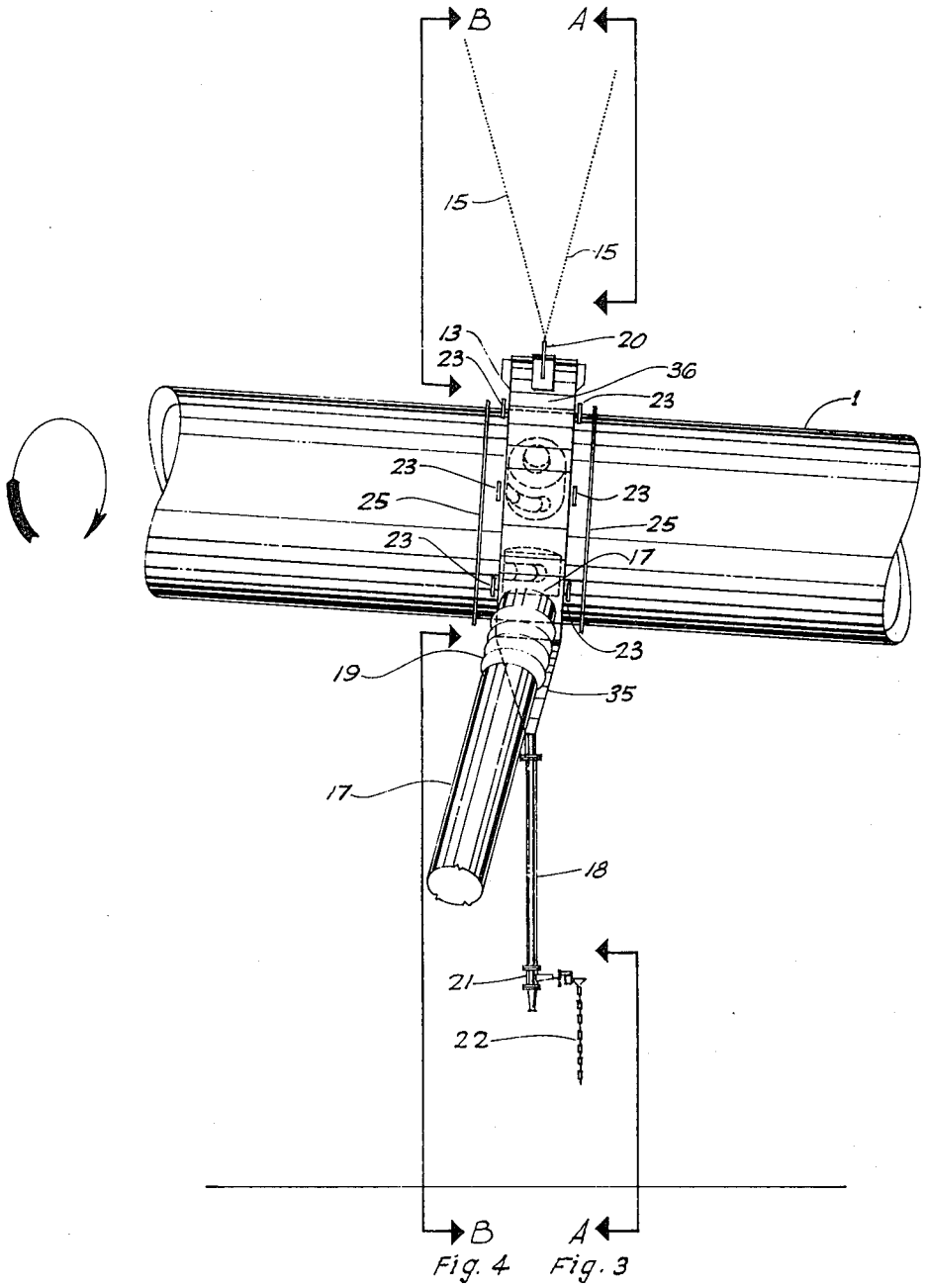
FIG. 2 is a drawing of that part of the exterior shell of the kiln which is particularly concerned with one of the embodiments of my invention shown in FIG. 1.
Figure 3:
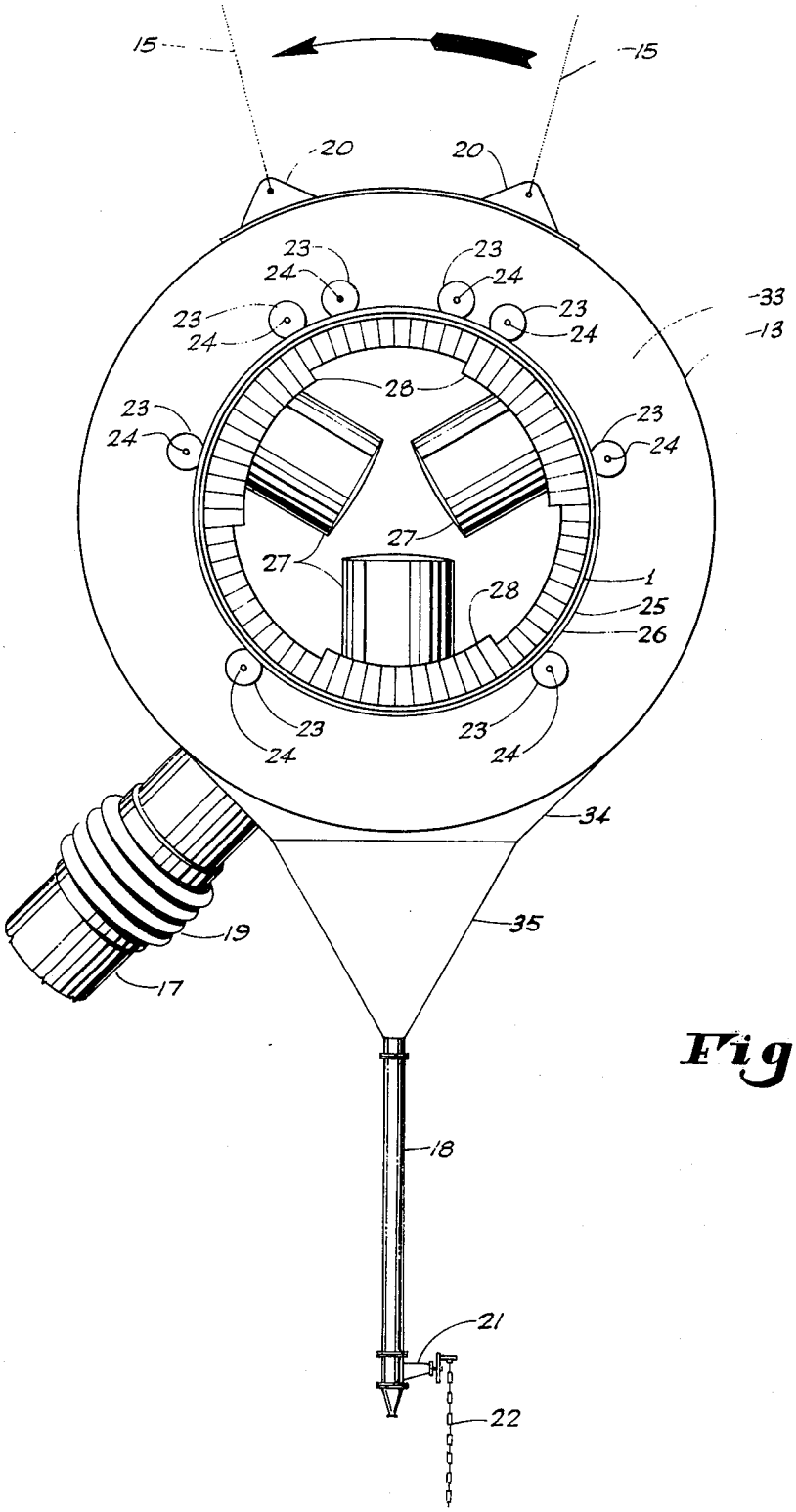
FIG. 3 is a drawing including both the interior and exterior of the kiln through section A—A, viewed in the direction of the arrows on FIG. 2.
Figure 4:
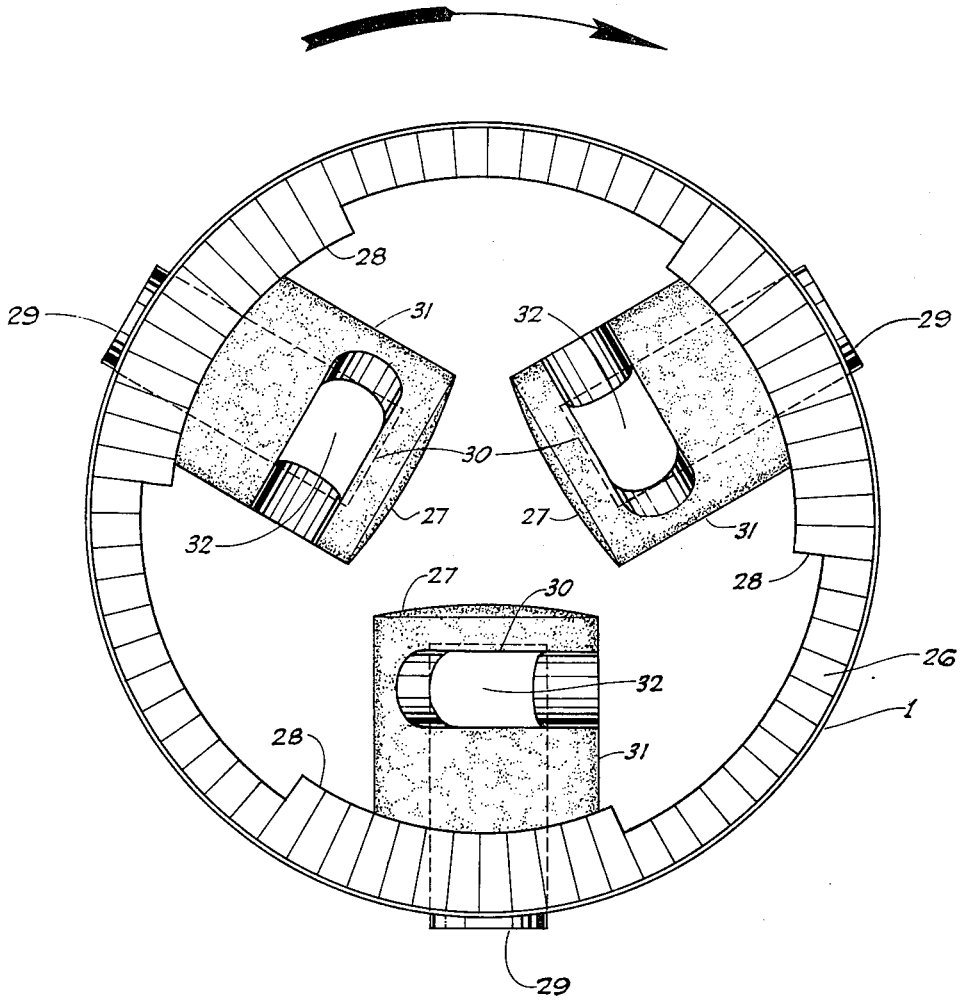
FIG. 4 is a drawing of the interior of the kiln through section B—B, viewed in the direction of the arrows on FIG. 2.
Figures 5, 7:
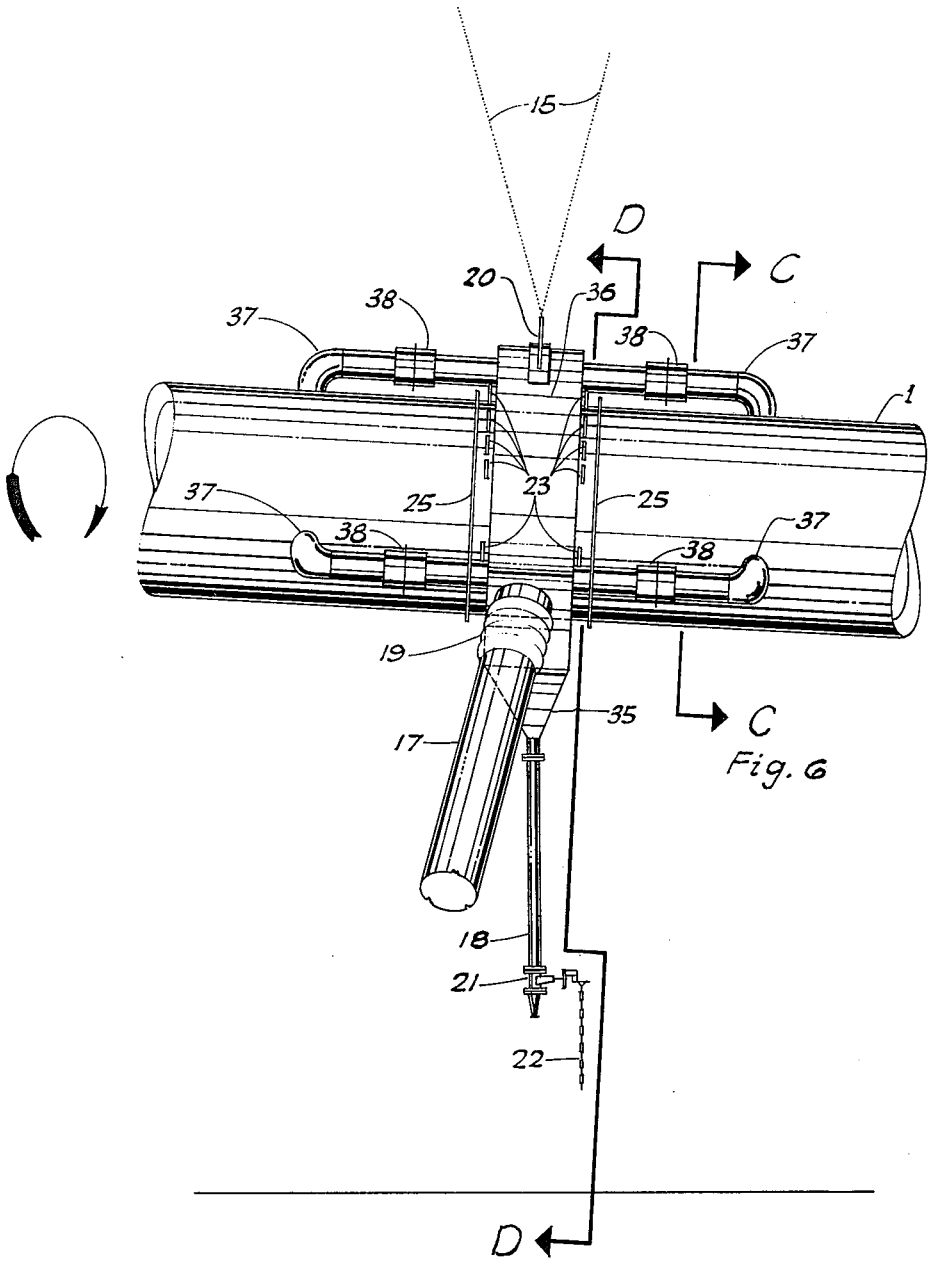
FIG. 5 is a drawing of that part of the exterior shell of the kiln shown in FIG. 2 modified to include another embodiment of my invention wherein two series of three tuyeres, each equally spaced around the kiln, are serviced from one shroud.
FIG. 7 is a drawing showing both the interior and exterior of the kiln through section D—D, viewed in the direction of the arrows of FIG. 5, showing the modification in kiln design to accommodate the connecting pipes.
Figure 6:
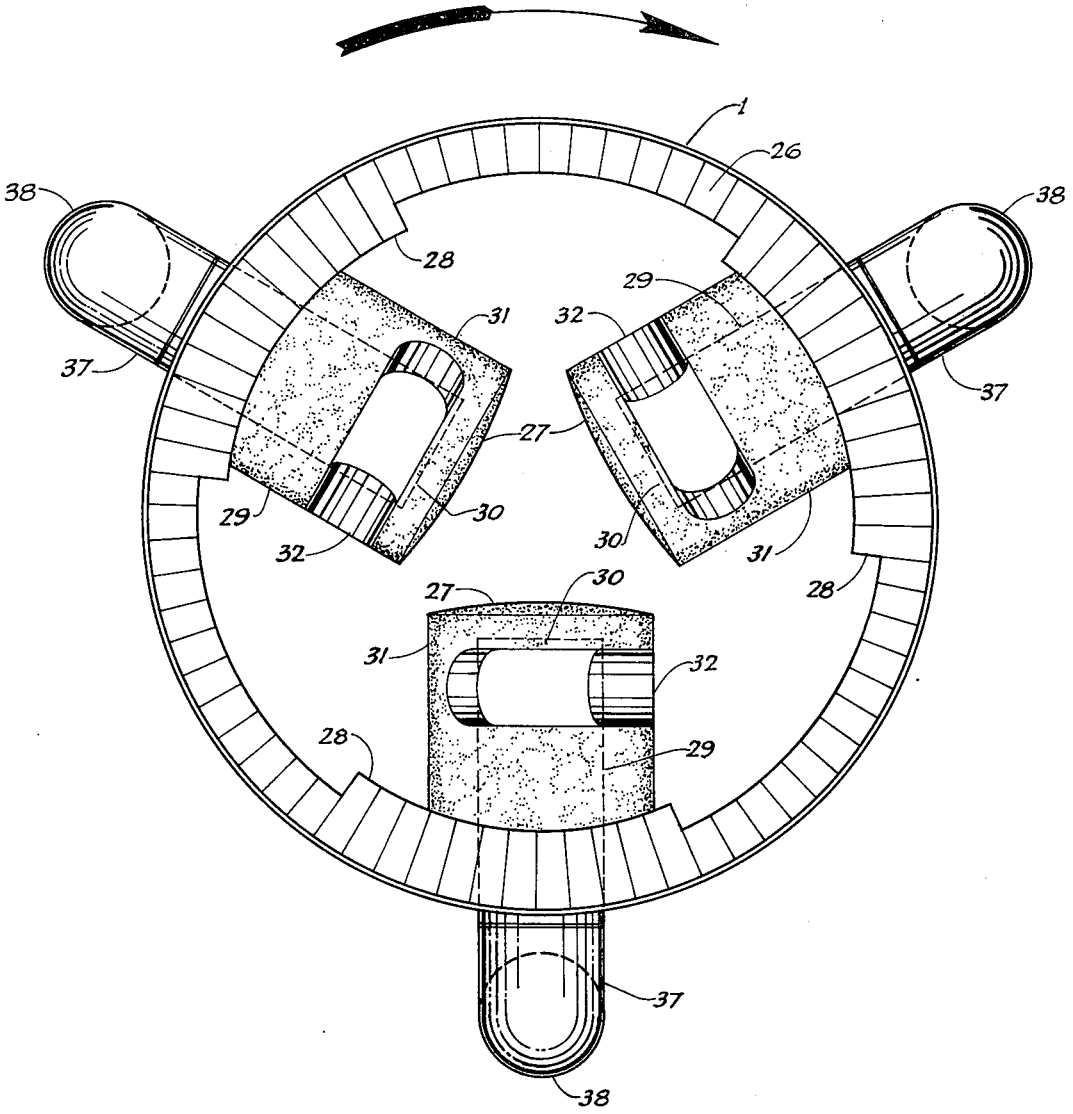
FIG. 6 is a drawing including both the interior and exterior of the kiln through section C—C, viewed in the direction of the arrows of FIG. 5.
Figure 7:
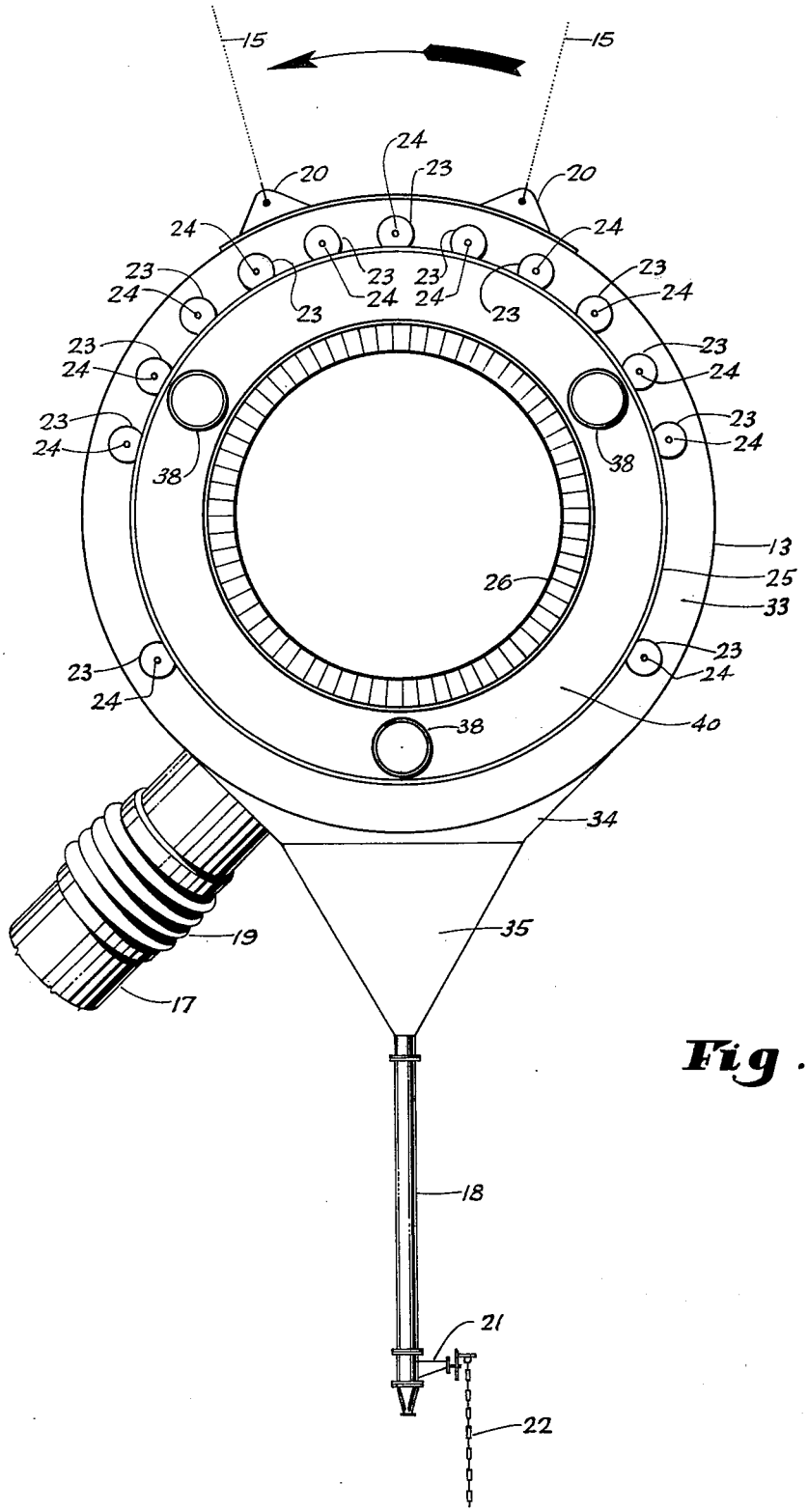
Figure 8:
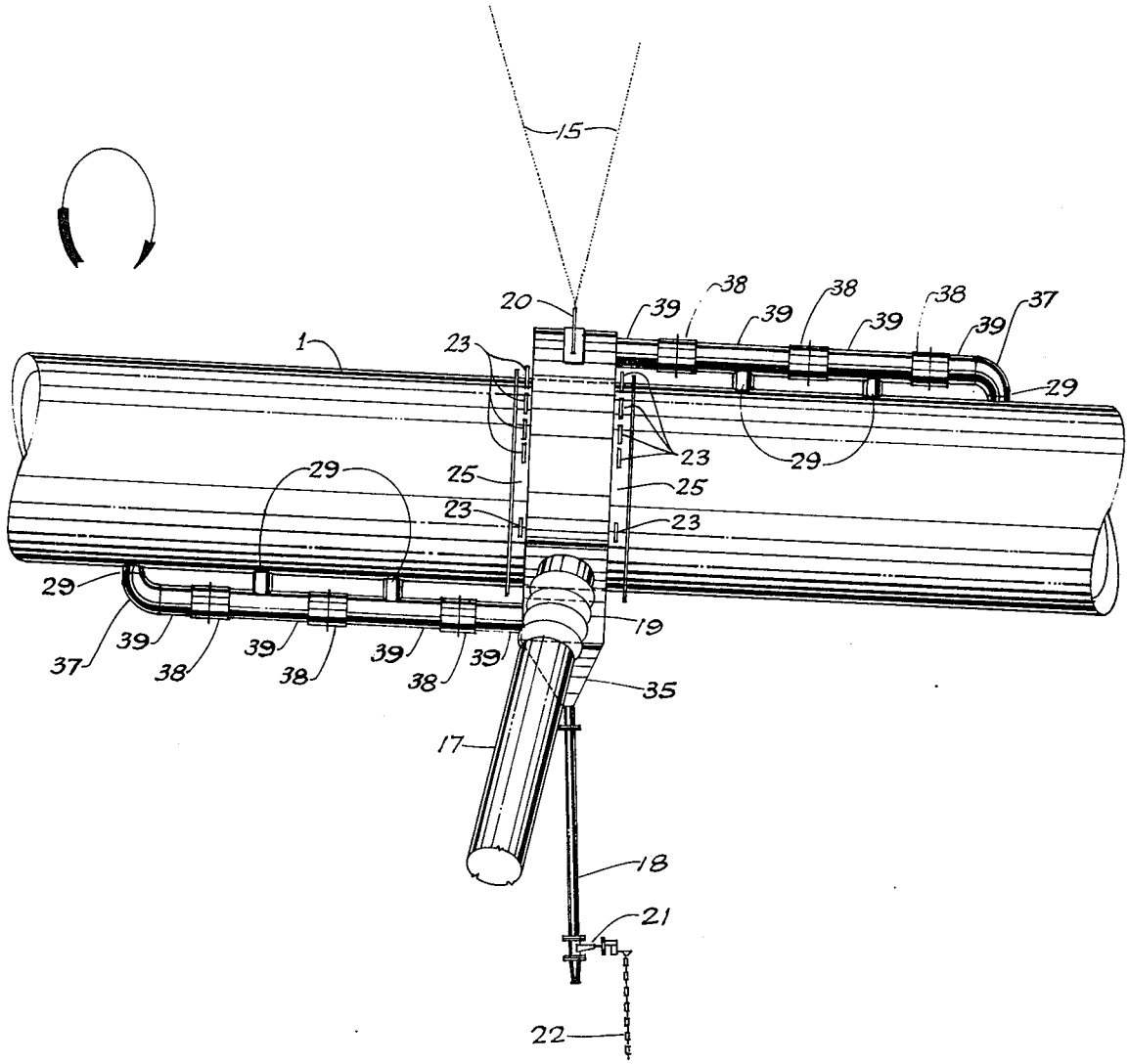
FIG. 8 is a drawing of that part of the exterior shell of the kiln shown in FIG. 2, modified to include still another embodiment of my invention wherein two series of longitudinally spaced tuyeres are spaced symmetrically with respect to a point on the longitudinal axis of the kiln and are serviced from one shroud.

As noted hereinbefore, the tuyeres are mounted through the kiln shell terminating outside the kiln in the shroud. In the embodiments shown in FIGS. 2 and 5, three tuyeres are shown in each series, symmetrically mounted in a single plane perpendicular to the horizontal axis of the kiln. In the embodiment shown in FIG. 2, the tuyeres are covered by the shroud. In FIG. 5, two series of three tuyeres are shown which are offset from the position of the shroud and are connected therewith by connecting pipes 37 and 38. In FIGS. 5 and 8, the tuyeres terminate external to the kiln in the shroud by way of the connecting pipes.

In another modification of my invention, as shown in FIG. 8, the sets of tuyeres are symmetrically and linearly spaced along the kiln shell. These series of tuyeres also are joined to the shroud by connecting pipes 37, 38, and 29. In this embodiment, the tuyeres and the shroud are both positioned in the middle one-half of the kiln, but the position of the tuyeres provides an elongated oxidation zone within the kiln.

As shown in FIG. 7, in order to provide for the termination of the tuyeres through the connecting pipes and into the shroud, the embodiment of FIG. 5, channel 25 is removed from a position adjacent to the shell 1 to a position on a manifold plate 40 at or near the outer edge of the shroud and the wheels 23 and axles 24 are moved from the inner edge of the transverse wall to a position near the curved surface plate 36 of the shroud and the adapter plates 34. The same modification is needed for the embodiment shown in FIG. 8. it is clear that in a functionally equivalent modification one could interchange the channel, wheels, and axles at this point or at any point in the description of this invention without modifying the scope of the invention.

Figure 9:
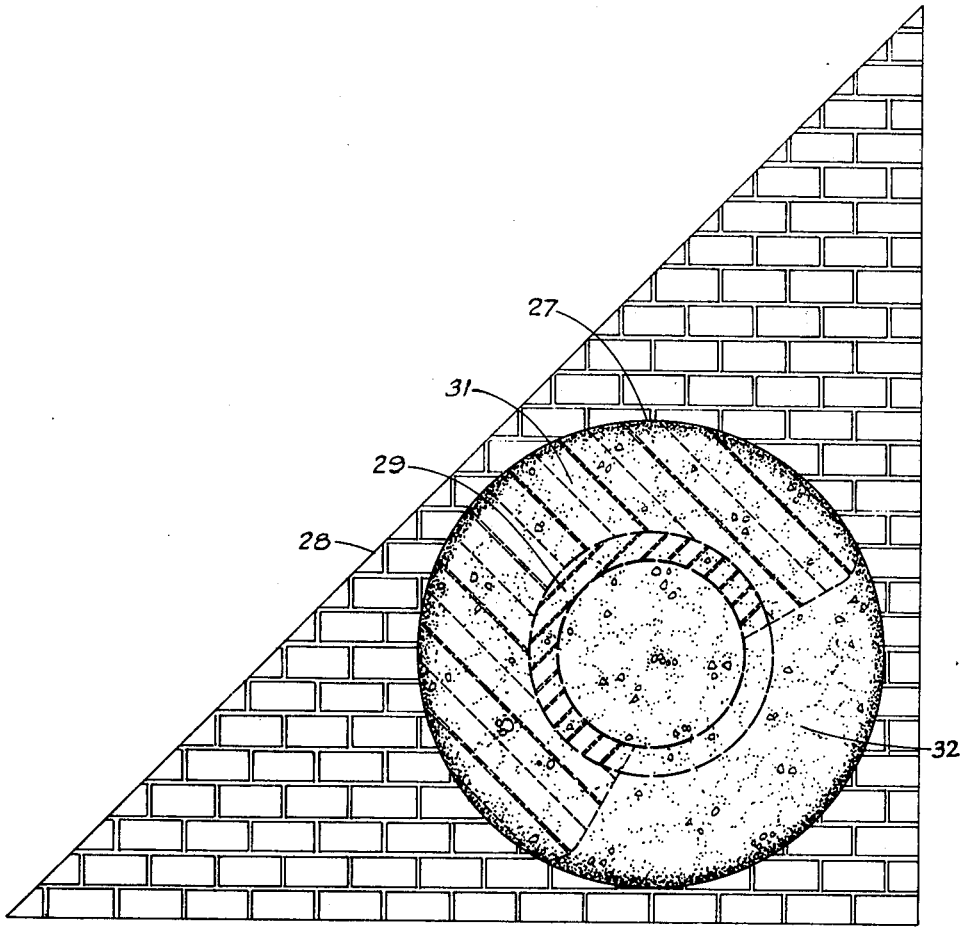
FIG. 9 is a drawing of a view of a tuyere and the surrounding kiln wall from a point inside the kiln directly above a tuyere.

Inside the kiln, the tuyere pipe 29, after it passes through the shell and refractory kiln lining 26, is covered by a cap 30 and refractory coating 31 thus providing a nozzle 32 pointed in the desired acute angle from the longitudinal axis of the kiln. In order to prevent coke buildup around the base of the tuyere, a raised triangular platform 28 is constructed in the refractory kiln lining as shown in FIG. 9 to direct the coke past the tuyere during rotation of the kiln.

Installation of the tuyeres of this invention into a typical coke calcining kiln allows the kiln to accept a greater throughput of coke. As for example, a kiln for the calcination of 600 tons of coke per day can be operated at 900 tons per day. The same unmodified 600 tons/day kiln is fired by 2500 cubic ft./ton of natural gas. At the same 600 tons/day throughput, a modified kiln is typically fired by 1350 cu. ft./ton of gas at the same rpm and by 1000 cu. ft./ton at 25 percent slower rpm. At 900 tons/day, the kiln uses about 1300 cu. ft./ton of gas. This conservation of combustion gas is not at the expense of yield or physical properties of the coke nor in the temperature nor time of calcination. Typically, the kiln exit gas temperature in the modified kiln is 400°–500° F. higher than in the unmodified kiln at the same throughput rate, indicating that the heating zone in the kiln extends for a greater length in the kiln.

I claim:

1. In a rotary kiln suitable for calcining normally solid carbonaceous material wherein the combustion gases and solid materials to be calcined travel countercurrently in the kiln during calcination, said kiln including, at its lower discharge end, a firing crown equipped with means for admitting combustible gases or liquids and air; a feeding means for such solid carbonaceous material to be calcined adapted to the upper end of the kiln; at least one series of at least two tuyeres passing through the wall of the kiln spaced symmetrically to and at about the middle one-half of the longitudinal axis of the kiln, each tuyere terminating within the kiln through a nozzle which is located on the side of the tuyere at a sufficient height above the bed of the carbonaceous material being calcined in the kiln to permit the discharge of exterior oxidizing gases passing through the nozzle; at least one shroud which surrounds the kiln in the tuyere area and which is movably mounted with respect to the kiln wall, thereby allowing the kiln but not the shroud to rotate; said tuyeres terminating on the outside of the kiln and within the shroud; and means to cause air or other oxygen-containing gases to flow into the shroud through the tuyeres and into the kiln, the improvement which comprises:

1. locating the nozzle in said tuyeres perpendicular to the radius of the kiln and pointing them at an acute angle from the longitudinal axis of the kiln in substantially the same direction toward the upper end of the kiln in order to direct the oxidizing gases toward said end and to provide a vortex flow pattern for said gases; and
2. means at the junction of each tuyere with the interior surface of the kiln lining to cause forced movement of the carbonaceous material being calcined past the tuyeres as the kiln rotates.

2. The rotary kiln of claim 1 wherein the means at the junction of each tuyere with the interior surface of the kiln lining to cause forced movement of the carbonaceous material past the tuyeres is a raised triangular platform of refractory material surrounding the tuyere.

* * * * *

UNITED STATES PATENT OFFICE

CERTIFICATE OF CORRECTION

Patent No. 4,053,365 Dated October 11, 1977

Inventor(s) Franklin H. Welter

It is certified that error appears in the above-identified patent and that said Letters Patent are hereby corrected as shown below:

| | |
|---|---|
| Column 4, line 8 | Change "thin" to -kiln- |
| Column 4, line 52 | Change "led" to -lead- |
| Column 5, line 15 | Change "29" to -39- |
| Column 5, line 28 | Change "it" to -It- |
| Column 5, line 44 | After "kiln" insert -designed- |

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*